United States Patent [19]

Franck

[11] 4,081,077

[45] Mar. 28, 1978

[54] COMPARTMENTED PACKAGE

[75] Inventor: Gerald R. Franck, St. Paul, Minn.

[73] Assignee: Minnesota Mining and Manufacturing Company, St. Paul, Minn.

[21] Appl. No.: 759,139

[22] Filed: Jan. 13, 1977

[51] Int. Cl.[2] ..... B65D 25/08

[52] U.S. Cl. ..... 206/219; 206/220

[58] Field of Search ..... 206/219, 220; 259/37, 259/60, DIG. 20; 220/20, 22.1

[56] References Cited

U.S. PATENT DOCUMENTS 3,815,878 6/1974 Baskas et al. ..... 206/219 X 3,835,834 9/1974 Brown et al. ..... 206/219 X

*Primary Examiner*—George T. Hall

*Attorney, Agent, or Firm*—C. Alexander; D. M. Sell; D. P. Edmundson

[57] ABSTRACT

A compartmented package is described comprising a unitary body member having a cavity therein adapted to contain at least two co-reactive components separated into compartments by means of an elongated mixing tool. The top portion of the cavity is closed or covered by means of an openable cover member (e.g. a transparent plastic film removably secured to the unitary body member).

9 Claims, 4 Drawing Figures

COMPARTMENTED PACKAGE

BACKGROUND OF THE INVENTION

This invention relates to packaging containers and, more particularly, to containers for multi-component materials.

There are many products (such as adhesives, sealants, etc.) which are sold in the form of separately packaged, co-reactive components which must be mixed (and often proportioned) by the ultimate consumer at the time of desired use of the product. Typically in such products the various reactive components are placed in separate packages, leaving to the consumer the task of both proportioning and mixing the components in the required manner.

In U.S. Pat. No. 3,145,838 (Van Deusen) a departmentalized package is described in which the various components are packaged in the same container which also may be made to serve as a mixing cup for the components. Such a package, of course, requires formation of a relatively complex configuration for the walls, etc. in such a manner that the package effectively maintains the components separated when desired but which also will be deformable at the time of use so as to permit inter-mixing of the components. It is also necessary for the ultimate consumer to supply his own mixing tool for use with the package. In U.S. Pat. No. 3,082,867 (Gelpey) a compartmented package is described in the form of a pouch containing two co-reactive components. A removeable clamp is used to prevent inter-mixing of the components prior to the time of desired use. Mixing of the components is then accomplished by removing the clamp and squeezing the components together. Such a package does not provide a separate mixing device which can be used to stir the components or place the fully mixed product at the desired location.

SUMMARY OF THE INVENTION

In accordance with the present invention there is provided a compartmented package comprising a unitary body member having a cavity therein adapted to contain at least two co-reactive components separated into compartments by means of an elongated mixing tool. The top portion of the cavity is closed by means of an openable cover member (preferably removeably secured to the unitary body member).

The packaging container also serves as the mixing cup for the co-reactive components which are stirred by means of the elongated mixing tool, the mixing tool effectively separating the co-reactive components until they are to be mixed by the ultimate consumer. Accordingly, neither a separate mixing cup nor a separate mixing device is required. The packaging container of the invention is thus easy to handle, simple in construction, and is not messy in use.

DETAILED DESCRIPTION OF THE INVENTION

The invention is described in more detail hereinafter with reference to the accompanying drawings wherein like reference characters refer to the same parts throughout the several views and in which.

Figure 1:
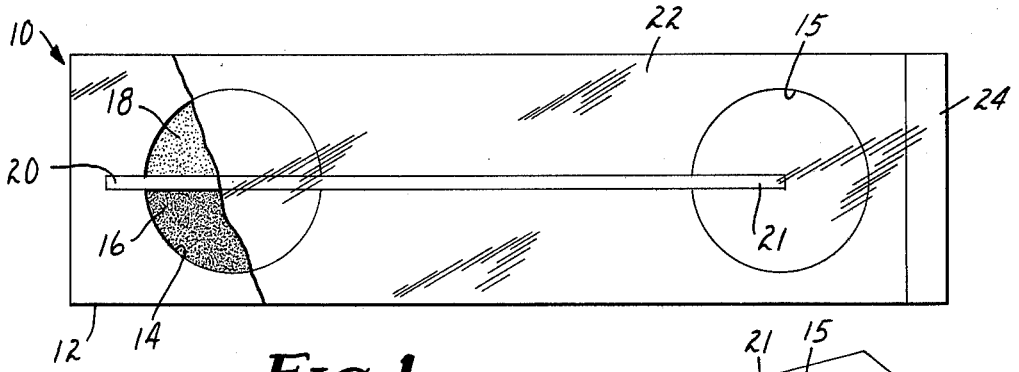
FIG. 1 is a partial cut-away, top view of a preferred compartmented package of the invention.
Figure 2:
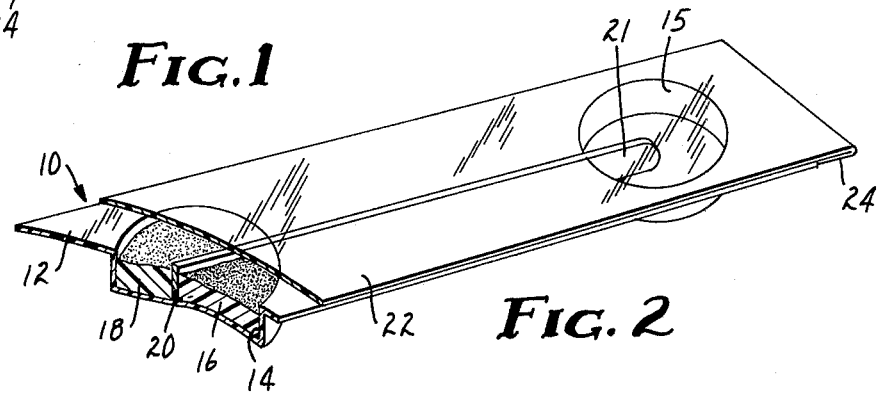
FIG. 2 is a partial cut-away, prospective view of the package of FIG. 1.

In FIGS. 1 and 2 there is shown compartmented package 10 comprising a unitary body member 12 having a cavity 14 therein which is adapted to contain two co-reactive components 16 and 18. Components 16 and 18 are spaced laterally from each other and are located in the same cavity 14. The components 16 and 18 are separated from each other by means of elongated mixing tool 20 which, as shown in the drawings, lies horizontally in the package and separates cavity 14 into two compartments. For this purpose it is not generally necessary for mixing tool 20 to maintain absolute separation between components 16 and 18 (i.e. some small amount of contact between the components in cavity 14 is permissible, particularly when the components are high viscosity materials). If absolute separation between the components is desired or necessary the mixing tool may be removeably adhered along its bottom edge to the bottom of cavity 14.

A cover sheet 22, preferably removeably secured to unitary body member 12, serves as an openable cover and also protects the co-reactive components and the mixing tool during shipment and handling. Preferably, cover sheet 22 is adhesively secured to the top of unitary body member 12 (e.g. by means of a pressure-sensitive adhesive). Cover sheet 22 may also be heat-sealed to the top of unitary body member 12, if desired. Preferably cover sheet 22 is a transparent plastic film so that the contents of the package may be viewed therethrough. In place of strippable cover sheet 22, of course, it is possible to simply use a small openable cover adhered only over cavity 14.

At the time of desired use of the contents of the package 10, cover sheet 22 can be easily removed from the top of the package by grasping tab 24 at one end of the package and pulling back the cover sheet to expose the contents of the package. One end 21 of mixing tool 20 can then be easily grasped manually since it preferably extends into a second cavity or depression 15 in the body member 12. Mixing tool 20 is then used to mix components 16 and 18 directly in cavity 14. Mixing tool 20 may also be used to place the mixture of components on the desired surface to be treated with such mixture of components.

Unitary body member 12 may be made of any material, although preferably it is made from an elongated plastic sheet which is semi-rigid or rigid. Cavity 14, and cavity 15, are easily provided by forming appropriate depressions in the plastic (e.g. by a molding operation). Of course, the entire body member 12 may be formed by means of injection molding. The slot-shaped depression, which accommodates a portion of the mixing tool, may also be formed by molding. Representative of suitable, commonly available, plastic materials for use in making the body member are polyvinylchloride, polystyrene, acetate, and others well known in the art. The body member may also be made of metal (e.g. aluminum), pasteboard, paper, and other such materials. The body member, of course, should be non-absorptive with respect to the components to be placed therein.

The size and shape of cavity 14, and cavity 15, are not critical and may be such as desired by the packager. Generally circular or elliptical shapes are considered quite useful, although other shapes (e.g. square, rectangular, etc.) are also useful.

The mixing tool 20 may be made of any suitable material such as wood, plastic, metal, or the like. The tool may be generally of any size convenient for its intended function, viz. to separate the co-reactive components prior to intended use of the packaged product and to be useful as a mixing or stirring tool. As illustrated in the drawings, some portion of the mixing tool is preferably not in contact with the co-reactive components so that such portion may serve as a handle during stirring.

Cover member 22 may also be made of any suitable material such as plastic film (e.g. polyester, polyvinylchloride, polyolefin, etc.), metal (e.g. aluminum foil), wax paper, etc. Cover member 22 is preferably transparent so that the contents of the package may be viewed prior to purchase and use. Typically cover member 22 is removeably secured to the top of body member 12 by means of a conventional pressure-sensitive adhesive, although it may also be adhered to the body member by heat-sealing which is well known.

The co-reactive components which are to be packaged may be any materials, e.g. epoxy adhesives, urethanes, polysulfides, polyesters, etc. Preferably, the components are in the form of thixotropic pastes so as to minimize or eliminate movement in the package during shipment and handling.

Figure 3:
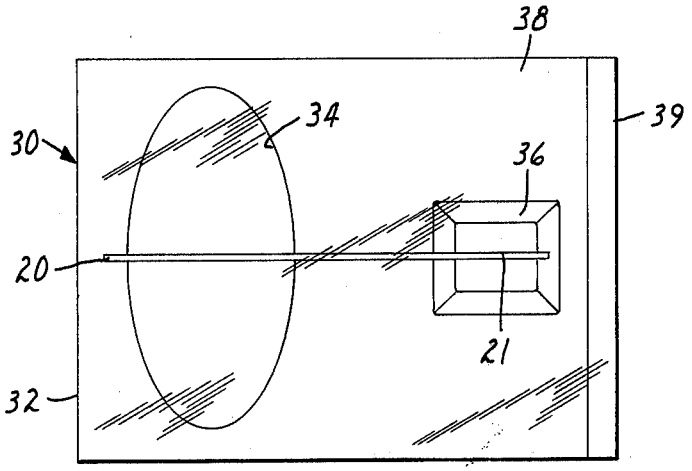
FIG. 3 is a top view of another compartmented package of the invention.

In FIG. 3 there is shown another embodiment of a compartmented package 30 comprising a unitary body member 32 having a depression or cavity 34 therein which is adapted to contain two co-reactive components spaced laterally from each other. The components are separated into compartments by means of elongated mixing tool 20. In this embodiment the compartments are of equal size (i.e. tool 20 passes through the middle of cavity 34). One end 21 of tool 20 is easy to grasp manually since it extends into a second depression or cavity 36 in body member 32. Cover sheet 38 is adhesively secured to the top of body member 32 and may be easily removed by grasping tab 39 and stripping sheet 36 from body member 32 at the time of intended use of the contents of the package.

Figure 4:
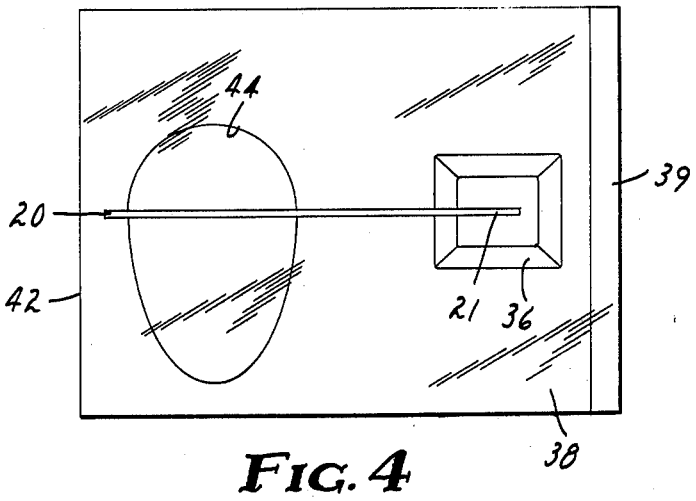
FIG. 4 is a top view of still another compartmented package of the invention.

In FIG. 4 there is shown still another embodiment of a compartmented package 40 comprising a unitary body member 42 having a cavity 44 therein which is adapted to contain two co-reactive components spaced laterally from each other. The components are separated into compartments by means of elongated mixing tool 20. In this embodiment the compartments are not of equal size since the package is intended for use with co-reactive components of the type in which unequal portions of the materials are to be mixed.

Many other variants within the scope of the present invention will be apparent to those skilled in the art.

What is claimed is:

1. A compartmented package comprising a unitary body member having a cavity therein adapted to contain at least two co-reactive components separated into compartments by means of an elongated mixing tool, the top portion of said cavity being closed by means of an openable cover member, wherein a portion of said mixing tool is fitted into a slot-shaped depression in said body member.

2. A compartmented package in accordance with claim 1, wherein said unitary body member comprises an elongated sheet of plastic and said cavity comprises a depression in said sheet.

3. A compartmented package in accordance with claim 1, wherein one end of said mixing tool extends into a second cavity in said body member which is adapted to permit manual grasping of said end of said mixing tool.

4. A compartmented package in accordance with claim 1, wherein said mixing tool separates said cavity into two compartments of equal size which are spaced laterally from each other.

5. A compartmented package in accordance with claim 1, wherein said mixing tool separates said cavity into two compartments of unequal size which are spaced laterally from each other.

6. A compartmented package in accordance with claim 1, wherein said cavity is generally circular.

7. A compartmented package in accordance with claim 1, wherein said cavity is elliptical.

8. A compartmented package in accordance with claim 1, wherein said cover comprises a sheet which is removeably secured to the top surface of said body member by means of a pressure-sensitive adhesive.

9. A compartmented package in accordance with claim 1, wherein said cover member comprises a transparent plastic film removeably secured to said unitary body member.

* * * * *